US011285533B2

(12) United States Patent
Hellsen et al.

(10) Patent No.: US 11,285,533 B2
(45) Date of Patent: Mar. 29, 2022

(54) COMPOSITION AND METHOD

(71) Applicant: HÖGANÄS AB (PUBL), Höganäs (SE)

(72) Inventors: Ann-Christin Hellsen, Höganäs (SE); Zhou Ye, Höganäs (SE)

(73) Assignee: HÖGANÄS AB (PUBL), Höganäs (SE)

( * ) Notice: Subject to any disclaimer, the term of this patent is extended or adjusted under 35 U.S.C. 154(b) by 55 days.

(21) Appl. No.: 16/072,555

(22) PCT Filed: Jan. 31, 2017

(86) PCT No.: PCT/EP2017/052006

§ 371 (c)(1),
(2) Date: Jul. 25, 2018

(87) PCT Pub. No.: WO2017/134039

PCT Pub. Date: Aug. 10, 2017

(65) Prior Publication Data

US 2019/0060992 A1 Feb. 28, 2019

(30) Foreign Application Priority Data

Feb. 1, 2016 (EP) ..... 16153676

(51) Int. Cl.
*B22F 1/10* (2022.01)
*C22C 33/02* (2006.01)
(Continued)

(52) U.S. Cl.
CPC ..... *B22F 1/10* (2022.01); *B22F 1/0003* (2013.01); *B22F 1/16* (2022.01); *B22F 3/02* (2013.01);
(Continued)

(58) Field of Classification Search
None
See application file for complete search history.

(56) References Cited

U.S. PATENT DOCUMENTS 2,383,827 A 8/1945 Sprung
4,601,765 A * 7/1986 Soileau ..... H01F 41/0246 148/104
(Continued)

FOREIGN PATENT DOCUMENTS

DE 3439397 A1 4/1986
EP 1246209 B1 10/2006
EP 2509081 A1 10/2012

OTHER PUBLICATIONS

International Search Report (PCT/ISA/210) dated Apr. 20, 2017, by the European Patent Office as the International Searching Authority for International Application No. PCT/EP2017/052006.
(Continued)

*Primary Examiner* — Xiaobei Wang
(74) *Attorney, Agent, or Firm* — Buchanan Ingersoll & Rooney P.C.

(57) ABSTRACT

A composite iron-based powder mix suitable for soft magnetic applications such as inductor cores. Also, a method for producing a soft magnetic component and the component produced by the method. An iron-based powder composition including a mixture of: (a) phosphorous coated atomized iron particles which are further coated by a silicate layer; (b) phosphorous coated iron alloy particles, the iron alloy particles of 7% to 13% by weight silicon, 4% to 7% by weight aluminium, the balance being iron; and (c) a silicone resin.

21 Claims, 1 Drawing Sheet

(51) Int. Cl.

| | |
|---|---|
| ***B22F 1/00*** | (2022.01) |
| ***H01F 3/08*** | (2006.01) |
| ***B22F 1/16*** | (2022.01) |
| ***B22F 3/02*** | (2006.01) |
| ***B22F 3/24*** | (2006.01) |
| ***H01F 1/147*** | (2006.01) |
| ***H01F 27/255*** | (2006.01) |
| ***H01F 41/02*** | (2006.01) |

(52) U.S. Cl.
CPC ..... *B22F 3/24* (2013.01); *C22C 33/0278* (2013.01); *H01F 1/14791* (2013.01); *H01F 3/08* (2013.01); *H01F 27/255* (2013.01); *H01F 41/0246* (2013.01); *B22F 2003/248* (2013.01); *B22F 2301/35* (2013.01); *B22F 2998/10* (2013.01); *C22C 2202/02* (2013.01)

(56) References Cited

U.S. PATENT DOCUMENTS

| | | | |
|---|---|---|---|
| 5,063,011 | A | 11/1991 | Rutz et al. |
| 5,595,609 | A | 1/1997 | Gay |
| 6,069,220 | A | 5/2000 | Hoffmann et al. |
| 6,309,748 | B1 | 10/2001 | Lashmore et al. |
| 6,348,265 | B1 | 2/2002 | Jansson et al. |
| 6,372,348 | B1 | 4/2002 | Hanejko et al. |
| 6,562,458 | B2 | 5/2003 | Elgelid et al. |
| 6,756,118 | B2 | 6/2004 | Aichele et al. |
| 2014/0085039 | A1 | 3/2014 | Ye et al. |

OTHER PUBLICATIONS

Written Opinion (PCT/ISA/237) dated Apr. 20, 2017, by the European Patent Office as the International Searching Authority for International Application No. PCT/EP2017/052006.

* cited by examiner

M
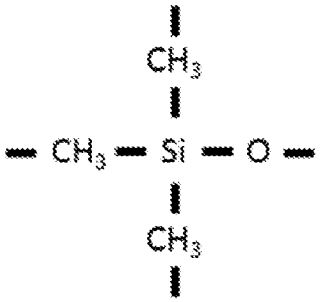
D
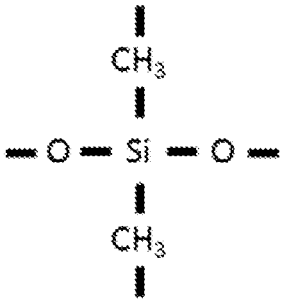
T
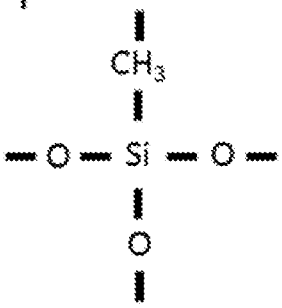
Q
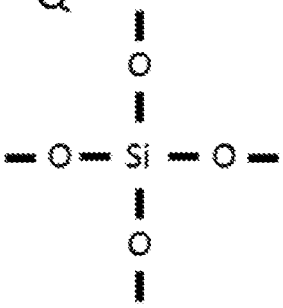

COMPOSITION AND METHOD

FIELD OF THE INVENTION

The present invention relates to a soft magnetic composite powder material which is useful for the preparation of soft magnetic components, as well as soft magnetic components which are obtained by using this soft magnetic composite powder.

BACKGROUND OF THE INVENTION

Soft magnetic materials are used for various applications, such as core materials in inductors, stators and rotors for electrical machines, actuators, sensors and transformer cores. Traditionally, soft magnetic cores, such as rotors and stators in electric machines, are made of stacked steel laminates. Soft magnetic composites may also be based on soft magnetic particles, usually iron-based, with an electrically insulating coating on each particle. By compacting the insulated particles, soft magnetic components are obtained. Use of such magnetic particles, in the form of a powder, makes it possible to produce soft magnetic components which can carry a three dimensional magnetic flux, allowing a higher degree of freedom in the design, than is possible by using traditional steel laminates The present invention relates to an iron-based soft magnetic composite powder, the core particles thereof being coated with a carefully selected coating rendering the material properties suitable for production of inductors through compaction of the powder followed by a heat treating process.

An inductor or reactor is a passive electrical component that can store energy in the form of a magnetic field created by the electric current passing through said component.

Magnetic permeability does not only depend on material carrying the magnetic flux but also on the applied electric field and the frequency thereof. In technical systems it is often referred to the maximum relative permeability which is maximum relative permeability measured during one cycle of the varying electrical field.

An inductor core may be used in power electronic systems for filtering unwanted signals such as various harmonics. In order to function efficiently an inductor core for such application shall have a low maximum relative permeability which implies that the relative permeability will have a more linear characteristic relative to the applied electric field, i.e. stable incremental permeability, $\mu_\Delta$ (as defined according to $\Delta B=\mu_\Delta*\Delta H$), and high saturation flux density. This enables the inductor to work more efficiently in a wider range of electric current, this may also be expressed as that the inductor has "good DC− bias". DC− bias may be expressed in terms of percentage of maximum incremental permeability at a specified applied electrical field, e.g. at 4000 A/m. Further low maximum relative permeability and stable incremental permeability combined with high saturation flux density enables the inductor to carry a higher electrical current which is inter alia beneficial when size is a limiting factor, a smaller inductor can thus be used.

One important parameter in order to improve the performance of soft magnetic component is to reduce its core loss characteristics. When a magnetic material is exposed to a varying field, energy losses occur due to both hysteresis losses and eddy current losses. The hysteresis loss is proportional to the frequency of the alternating magnetic fields, whereas the eddy current loss is proportional to the square of the frequency. Thus at high frequencies the eddy current loss matters most and it is especially important to reduce the eddy current loss and still maintaining a low level of hysteresis losses. This implies that it is desired to increase the resistivity of magnetic cores.

In the search for ways of improving the resistivity, different methods have been used and proposed. One method is based on providing electrically insulating coatings or films on the powder particles before these particles are subjected to compaction.

Thus there are a large number of patent publications which teach different types of electrically insulating coatings. Examples of published patents concerning inorganic coatings are the U.S. Pat. Nos. 6,309,748, 6,348,265 and 6,562,458. Coatings of organic materials are known from e.g. U.S. Pat. No. 5,595,609. Coatings comprising both inorganic and organic material are known from e.g. U.S. Pat. Nos. 6,372,348 and 5,063,011, and DE3,439,397, according to which publication the particles are surrounded by an iron phosphate layer and a thermoplastic material. EP1246209B1 describes a ferromagnetic metal based powder, wherein the surface of the metal-based powder is coated with a coating consisting of silicone resin and fine particles of clay minerals having layered structure such as bentonite or talc.

U.S. Pat. No. 6,756,118B2 relates to a soft magnetic powder metal composite comprising at least two oxides encapsulating powdered metal particles, the at least two oxides forming at least one common phase.

In order to obtain high performance soft magnetic composite components it must also be possible to subject the electrically insulated powder to compression moulding at high pressures as it is often desired to obtain parts having high density. High densities normally improve the magnetic properties. Specifically high densities are needed in order to keep the hysteresis losses at a low level and to obtain high saturation flux density. Additionally, the electrical insulation must withstand the compaction pressures needed without being damaged when the compacted part is ejected from the die. This in turn means that the ejection forces must not be too high.

Furthermore, in order to reduce the hysteresis losses, stress releasing heat treatment of the compacted part is required. In order to obtain an effective stress release the heat treatment should preferably be performed at a temperature above 300° C. and below a temperature where the insulating coating will be damaged, in an atmosphere of for example nitrogen, argon or air, or in vacuum.

The present invention has been done in view of the need for powder cores which are primarily intended for use at higher frequencies, i.e. frequencies above 2 kHz and particularly between 5 and 100 kHz, where higher resistivity and lower core losses are essential. Preferably the saturation flux density shall be high enough for core downsizing. Additionally it should be possible to produce the cores without having to compact the metal powder using die wall lubrication and/or elevated temperatures. Preferably these steps should be eliminated.

SUMMARY OF THE INVENTION

An object of the invention is to provide a new iron-based composite powder comprising a core of an iron based powder, the surface thereof coated with a new composite electrical insulated coating. The new iron based composite powder is especially suited to be used for production of inductor cores for power electronics. Cores made of such material have high mechanical strength, high resistivity, low core losses, high incremental permeability and saturation flux density.

Another object of the invention is to provide a method for producing such inductor cores.

In one embodiment, the iron based powder composition comprises or contains core particles which are atomized iron particles and phosphorus coated iron alloy particles, such as sendust particles. The atomized iron particles and the sendust particles are separately coated by a first phosphorous layer. The phosphorous-coated atomized iron particles are further coated with a silicate layer, thus providing iron particles with a silicate coating. The silicate coated iron particles and the phosphorous coated iron alloy particles are then mixed with a silicone resin. Optionally, a lubricant may be added.

In particular, according to a first aspect, the present invention relates to an iron-based powder composition comprising a mixture of: (a) phosphorous coated atomized iron particles which are further coated by a silicate layer; (b) phosphorous coated iron alloy particles, such as sendust, consisting of 7% to 13% by weight silicon, 4% to 7% by weight aluminium, the balance being iron; and (c) a silicone resin. The ratio of atomized iron particles to iron alloy particles in the iron-based powder composition may vary from 90/10 to 50/50, preferably between 80/20 to 60/40.

In one embodiment, the iron-based powder composition comprises or consists of (a) atomized iron particles, and (b) iron alloy particles composed of a mixture of silicon, aluminium and iron; and the coated particles (a) and (b) are further admixed with (c) a powdered silicone resin. The atomized iron particles (a) are coated with a phosphorous layer and then coated with a silicatelayer; the iron alloy particles (b) are coated with a phosphorous layer. The silicate layer on (a) contains an alkaline silicate combined with a clay mineral containing a phyllosilicate, wherein the combined silicon-oxygen tetrahedral layer and hydroxide octahedral layers thereof preferably are electrically neutral, such as Kaolinite.

In addition, according to a second aspect, the invention provides a method for producing a compacted and heat treated component, such as an inductor core, the method comprising the steps of:

a) providing a coated iron based powder composition according to the first aspect of the invention;

b) compacting the coated iron and sendust powder mixture, optionally mixed with a lubricant, in a uniaxial press movement in a die at a compaction pressure between 400 and 1200 MPa;

c) ejecting the compacted component from the die;

d) heat treating the ejected component at a temperature up to 800° C.

In a prefered embodiment in step b) the die is at an elevated temperature, preferably wherein in step b) the die temperature is between 25 and 80° C.

Furthermore, the invention provides an electromagnetic component, such as an inductor core, produced by the method above.

In contrast to many used and proposed methods, in which low core losses are desired, it is a special advantage of the present invention that it is not necessary to use any organic binding agent in the powder composition, which powder composition is later compacted in the compaction step. Heat treatment of the green compact can therefore be performed at higher temperature without the risk that any organic binding agent decomposes; a higher heat treatment temperature will also improve the flux density and decrease core losses. The absence of organic material in the final, heat treated core also allows the core to be used in environments with elevated temperatures without risking decreased strength due to softening and decomposition of an organic binder, and improved temperature stability is thus achieved.

DETAILED DESCRIPTION OF THE INVENTION

Figure Legends

FIG. 1 Schematic of the different silicon resin subunits.

Throughout the text, the terms "layer" and "coating" may be used interchangeably.

The present invention provides an iron-based powder composition comprising a mixture of:

(a) phosphorous coated atomized iron particles which are further coated by a silicate layer;

(b) phosphorous coated iron alloy particles, the iron alloy particles consisting of 7% to 13% by weight silicon, 4% to 7% by weight aluminium, the balance being iron; and (c) a silicone resin.

The iron particles may be in the form of a pure iron powder having low content of contaminants such as carbon or oxygen. The iron content is preferably above 99.0% by weight, however it may also be possible to utilise iron-powder alloyed with e.g. silicon. For a pure iron powder, or for an iron-based powder alloyed with intentionally added alloying elements, the powders may contain besides iron and possible present alloying elements, trace elements resulting from inevitable impurities caused by the method of production. Trace elements are present in such a small amount that they do not (or only marginally) influence the properties of the material. Examples of trace elements may be carbon up to 0.1%, oxygen up to 0.3%, sulphur and phosphorous up to 0.3% each and manganese up to 0.3%.

The iron particles may be water atomized or gas atomized. Methods for atomizing iron are known in the literature.

The mean particle size of the core particles in the iron-based powder is determined by the intended use, i.e. which frequency the component is suited for. A Sympatec HELOS instrument (Sympatec, Germany) was used for measuring the particle size, using laser diffraction according to SIS Standard SS-ISO13320-1, dated 22 Sep. 2000. The mean particle size of the core particles is approximately equal to the mean size of the coated powder as the coating is very thin, and the mean particle size may be between 20 to 300 μm. Examples of mean particle sizes for suitable iron-based powders are e.g. 20-80 μm, a so called 200 mesh powder, 70-130 μm, a 100 mesh powder, or 130-250 μm, a 40 mesh powder.

The weight ratio of atomized iron particles to iron alloy particles in the iron-based powder composition may vary from 90/10 to 50/50, preferably between 80/20 to 60/40.

In one embodiment, the atomized iron particles are coated with a phosphorous containing layer prior to coating with the alkaline silicate coating and then mixed with phosphorus coated iron alloy particles.

The phosphorous containing coating which is applied to the bare iron-based powder may be applied according to the methods described in U.S. Pat. No. 6,348,265. This means that the iron or iron-based powder can be mixed with phosphoric acid dissolved in a solvent such as acetone followed by drying in order to obtain a thin phosphorous and oxygen containing coating on the powder. The amount of added solution depends inter alia on the particle size of the powder; however the amount shall be sufficient in order to obtain a coating having a thickness between 20 and 300 nm.

Alternatively, it would be possible to add a thin phosphorous containing coating by mixing an iron-based powder with a solution of ammonium phosphate dissolved in water or using other combinations of phosphorous containing substances and other solvents. The resulting phosphorous containing coating cause an increase in the phosphorous content of the iron-based powder of between 0.01 to 0.15%.

The iron alloy particles (b) may consist essentially of 7% to 13% by weight silicon, 4% to 7% by weight aluminium, the balance being iron, the remainder being impurities. Such a powder is known in the field as sendust. Typically, sendust essentially contains 84-86% Fe, 9-10% Si and 5-6% Al, on a weight basis.

In one embodiment, the silicate layer may comprise particles of a clay and a water soluble alkaline silicate. The silicate layer normally comprises an alkaline silicate combined with a clay mineral containing a phyllosilicate. The silicate coating can be applied to the phosphorous coated iron-based powder by mixing the powder with particles of a clay, or a mixture of clays containing defined phyllosilicate, and a water soluble alkaline silicate, commonly known as water glass, followed by a drying step at a temperature between 20-250° C., optionally in vacuum.

Commonly, the water glass is characterised by its ratio, i.e. amount of $SiO_2$ divided by amount of $Na_2O$, $K_2O$ or $Li_2O$ as applicable, either as molar or weight ratio. The molar ratio of the water soluble alkaline silicate shall be 1.5-4, both end points included. If the molar ratio is below 1.5 the solution becomes too alkaline, if the molar ratio is above 4 $SiO_2$ will precipitate.

Phyllosilicates constitute the type of silicates where the silicontetrahedrons are connected with each other in the form of layers having the formula $(Si_2O_5^{2-})_n$. These layers are combined with at least one octahedral hydroxide layer forming a combined structure. The octahedral layers may for example contain either aluminium or magnesium hydroxides or a combination thereof. Silicon in the silicontetrahedral layer may be partly replaced by other atoms. These combined layered structures may be electroneutral or electrically charged, depending on which atoms are present.

It has been noticed that the type of phyllosilicate is of vital importance in order to fulfil the objects of the present invention. Thus, the phyllosilicate shall be of the type having uncharged or electroneutral layers of the combined silicontetrahedral- and hydroxide octahedral—layer. Examples of such phyllosilicates are kaolinite present in the clay kaolin, pyrofyllit present in phyllite, or the magnesium containing mineral talc.

In one preferred embodiment, 50 wt-% or more is the phyllosilicate kaolinite.

The mean particle size of the clays containing defined phyllosilicates shall be in the size range of from 0.1 μm to 3.0 μm, or preferably from 0.1 μm to 2.5 μm, or more preferably from 0.1 μm to 2.0 μm, or even more preferably from 0.1 μm to 0.4 μm, or from 0.1 μm to 0.3 μm. Most preferably, the clay particle size is 0.25 μm. The particle size of the clay particles is determined by analytical centrifuge analysis.

The amount of clay containing defined phyllosilcates to be mixed with the coated iron-based powder can be between 0.2-5%, preferably between 0.5-4%, by weight of the coated composite iron-based powder i.e. by weight based on the total iron-based powder composition.

The amount of alkaline silicate calculated as solid alkaline silicate to be mixed with the coated iron-based powder shall be between 0.1-0.9% by weight of the coated composite iron-based powder, preferably between 0.2-0.8% by weight of the iron-based powder i.e. by weight based on the total iron-based powder composition. It has been shown that various types of water soluble alkaline silicates can be used, thus sodium, potassium and lithium silicate can be used.

The phosphorous and alkaline silicate coated atomized iron particles and phosphorus coated sendust particles are subsequently mixed with a powdered silicone resin. The silicone resin may be added in an amount of 0.3-1.5% of the total mixture, preferably between 0.4-1.0% by weight.

The silicone resin may contain 50-100% phenyl substituents, preferably between 75-100% and most preferably 100% phenyl substituents.

The silicone resins are polymeric compounds that contain a Si—O—Si linked backbone where the silicon atoms have one or more organic substituents. The structural units of silicones can be classified accordingly:

A monofunctional unit (M) contains three organic substituents, most often methyl groups.

A difunctional unit (D) contains two substituents; these can be ether pure methyl or a combination of phenyl and methyl groups, however, due to steric hindrance it cannot solely contain phenyl groups.

A trifunctional unit (T) has one organic substituent and this can be 100% phenyl substituents.

A tetrafunctional unit (Q) contains no organic substituents; it is a four dimensional branching unit.

Mono and difunctional units form silicon fluids and chains, while tri and tetrafunctional units are cross linkers used to form the densely branched three dimensional networks of the silicone resins.

DT resins are silicon resins formed from D and T units. The resins are made by hydrolysis of alkoxysilanes followed by a condensation reaction to form the polysiloxane (U.S. Pat. Nos. 2,383,827 and 6,069,220). In the case of alkoxysilanes, the hydrolysis of the alkoxy groups and the condensation reaction does not go to full completion. This means that a fraction of the hydroxyl and alkoxy groups remain in the resin after production. The properties of these resins are influenced by the type of organic substituents on the silicone atom, the ratio of organic groups R to Si, the total contents of organic groups and the molar mass. The degree of cross linking, i.e. the ratio of organic groups affects flexibility and hardness. Ratios around 1 results in a hard, vitreous resin, while ratios around 1.7 give soft, flexible resins.

Preferred resins range from a purely methyl substituted silicone resin to a purely phenyl substituted resin; the functional groups may be one or more chosen from the group consisting of: —O, —OH, —$CH_3O$, —$C_2H_5O$.

In one embodiment, the silicone resin contains 50-100% phenyl substituents, preferably between 60-100%, 75-100% or 90-100%, and most preferably 100% phenyl substituents.

In another embodiment, the total contents of hydroxy, methoxy and ethoxy functional groups in the silicone resin is above 2 wt %, preferably above 5 wt % and most preferably above 7 wt %.

In another embodiment of the invention, the melting point of the silicone resin is above 45° C., preferably above 55° C., and most preferably above 65° C.

The iron-based powder composition as described above may further comprise a lubricant. Suitable lubricants may be an organic lubricant such as a wax, an oligomer or a polymer, a fatty acid based derivate or combinations thereof. Examples of suitable lubricants are EBS, i.e. ethylene bis-stearamide, Kenolube® available from Höganäs AB, Sweden, metal stearates such as zinc stearate or fatty acids or other derivates thereof. The lubricant may be added in an amount of 0.05-1.5% of the total mixture, preferably between 0.1-1.2% by weight.

In one additional aspect, the invention also provides a method for producing a compacted and heat treated component, comprising the steps of:

a) providing a composite iron-based powder composition according to the invention,
b) compacting the composite iron-based powder composition, optionally mixed with a lubricant, in a uniaxial press movement in a die at a compaction pressure between 400 and 1200 MPa, optionally with an elevated temperature of the die,
c) ejecting the compacted component from the die,
d) heat treating the ejected component in a non-reducing atmosphere at a temperature up to 800° C.

The present invention also provides a component produced according to the method described above. The component may be an inductor core, preferably having a resistivity, ρ, above 10000, preferably above 20000 and most preferably above 30000 μΩm; an initial relative incremental permeability above 80, preferably above 90 and most preferably above 100; and core loss less than 12 W/kg at a frequency of 20 kHz; induction of 0.05 T.

This good saturation flux density, achieved by the material according to the invention, makes it possible to downsize inductor components and still maintain good magnetic properties.

Compaction and Heat Treatment

Before compaction, the coated iron-based composition may be mixed with a suitable organic lubricant such as a wax, an oligomer or a polymer, a fatty acid based derivate or combinations thereof. Examples of suitable lubricants are EBS, i.e. ethylene bisstearamide, Kenolube® available from Höganäs AB, Sweden, metal stearates such as zinc stearate or fatty acids or other derivates thereof. The lubricant may be added in an amount of 0.05-1.5% of the total mixture, preferably between 0.1-1.2% by weight.

Compaction may be performed at a compaction pressure of 400-1200 MPa at ambient or elevated temperature.

After compaction, the compacted components are subjected to heat treatment at a temperature up to 800° C., preferably between 600-750° C. Examples of suitable atmospheres at heat treatment are inert atmosphere such as nitrogen or argon or oxidizing atmospheres such as air, or a mixture thereof.

The powder magnetic core of the present invention is obtained by pressure forming an iron-based magnetic powder covered with an electrically insulating coating and mixed with silicone resin powder. The core may have transverse rapture strength (TRS) higher than 15 MPa, or preferably higher than 20 MPa, or most preferably higher than 25 MPa. The core may be characterized by low total losses in the frequency range 2-100 kHz, normally 5-100 kHz, of less than 12 W/kg at a frequency of 20 kHz and induction of 0.05 T. In addition, the core losses in the frequency range 0-1 kHz should also be low, preferably less than 45 W/kg at a frequency of 1 kHz and induction of 0.5 T. Further a resistivity, ρ, higher than 10000, or preferably higher than 20000 or most preferably higher than 30000 μΩm, and an initial incremental permeability higher than 80, or preferably higher than 90, or most preferably higher than 100.

EXAMPLES

The following examples are intended to illustrate particular embodiments and should not be construed as a limitation of the scope of the invention.

Example 1

A pure water atomized iron powder having a content of iron above 99.5% by weight was used as core particles; the mean particle size of the powder was about 45 μm. The iron particles were treated with a phosphorous containing solution, thereby obtaining phosphorous coated iron particles. The coating solution was prepared by dissolving 30 ml of 85% weight of phosphoric acid in 1 000 ml of acetone, and 40 ml-60 ml of acetone solution was used per 1000 gram of powder. After mixing the phosphoric acid solution with the metal powder, the mixture is allowed to dry. The obtained dry phosphorous coated iron powder was further blended with kaolin (available from KaMin LLC, 822 Huber Road, Macon, Ga. 31217, USA) according to Table 1, and sodium silicate (0.4% by dry weight) and then dried at 120° C.

Ground sendust (typically 85% Fe, 9,5% Si and 5,5% Al) was treated as above with a phosphorous containing solution. The phosphorus coated sendust particles and the phosphorus and alkali silicate coated iron particles were mixed in a ratio of 70/30 iron particles/sendust. The powder mixture was further mixed with methyl silicone resin (SILRES MK) obtained from Wacker Chemie, Germany, according to Table 1 and 0.5% lubricant and compacted at 800 MPa and 60° C. into rings with an inner diameter of 45 mm, an outer diameter of 55 mm and a height of 5 mm for magnetic measurements; and compacted at 800 MPa and 60° C. into IE-bars (definition) for TRS measurements. The compacted components were thereafter subjected to a heat treatment process at 700° C. in a nitrogen/oxygen atmosphere (2500 ppm $O_2$) for 0.5 hours.

The specific resistivity of the obtained samples was measured by a four point measurement. The transverse rapture strength of the compacts was measured by a three point bending test. For maximum permeability, $\mu_{max}$, and coercivity measurements, the rings were "wired" with 100 turns for the primary circuit and 20 turns for the secondary circuit, enabling measurements of magnetic properties with the aid of a hysteresisgraph, Brockhaus MPG 200. For core loss, the rings were "wired" with 100 turns for the primary circuit and 30 turns for the secondary circuit with the aid of Walker Scientific Inc. AMH-401 POD instrument.

When measuring incremental permeability, the rings were wounded with a third winding supplying the DC–bias current.

Unless otherwise stated all tests in the following examples were performed accordingly.

TABLE 1

| Identity | Additives: Kaolin [wt %] | Additives: Silicon resin [wt %] | Component properties: TRS [MPa] | Component properties: Density [g/cm3] | Component properties: Resistivity [μΩm] | Core loss@ 0.5 T & 1 kHz [W/kg] | Core loss@ 0.1 T & 20 kHz [W/kg] | μ(in)@ 10 kHz & 0 A/m |
|---|---|---|---|---|---|---|---|---|
| A comp | 0 | 0.6 | 30 | 6.58 | 9 | 74.4 | 1661.0 | 99 |
| B inv | 0.5 | 0.6 | 34 | 6.44 | 43000 | 43.3 | 169.1 | 89 |
| C inv | 0.75 | 0.6 | 32 | 6.42 | 61000 | 42.8 | 160.4 | 87 |
| D inv | 1 | 0.6 | 31 | 6.39 | 630000 | 43.4 | 174.9 | 86 |
| E comp | 1 | 0 | 21 | 6.50 | 23500 | 40.6 | 168.0 | 91 |
| F inv | 1 | 0.2 | 24 | 6.44 | 105000 | 41.8 | 165.0 | 89 |
| G inv | 1 | 0.4 | 30 | 6.42 | 990000 | 42.2 | 164.6 | 88 |
| H comp | 0 | 0 | 40 | 6.65 | 3 | 118.4 | n/m | 66 |

In order to show the impact of the presence of kaolin and sodium silicate in the second coating and the impact of using a silicone resin on the properties of the compacted and heat treated component, samples A-H, were prepared according to Table 1 which also shows results from testing of the components.

magnetic measurements; and compacted at 800 MPa and 60 C into IE-bars for TRS measurements. The compacted components were thereafter subjected to a heat treatment process at 700° C. in a nitrogen/oxygen atmosphere (2500 ppm $O_2$) for 0.5 hours. Table 2 also shows results from testing of the components.

TABLE 2

| ID | Silicone resin properties: Mean melting point [° C.] | Silicone resin properties: Functional group content [wt %] | Silicone resin properties: Phenyl substituents [%] | Component properties: TRS [MPa] | Component properties: Density [g/cm3] | Component properties: Resistivity [μΩm] | Core loss@ 0.5 T & 1 kHz [W/kg] | Core loss@ 0.2 T 20 kHz [W/kg] | μ(in) @ 10 kHz & 0 A/m |
|---|---|---|---|---|---|---|---|---|---|
| I inv | 60 | 8 | 100 | 26 | 6.54 | 1506250 | 33.2 | 145.1 | 100 |
| J inv | 75 | 6 | 100 | 24 | 6.53 | 1431250 | 32.7 | 149.0 | 98 |
| K inv | 67.5 | 7 | 95 | 27 | 6.51 | 1506250 | 32.7 | 148.5 | 97 |
| L inv | 67.5 | 5 | 95 | 26 | 6.52 | 1475000 | 32.6 | 148.6 | 95 |
| M inv | 45 | 4 | 0 | 31 | 6.48 | 900000 | 33.2 | 154.1 | 93 |

As can be seen from table 1, the combination of atomized iron with a primary phosphorous coating layer and a second coating layer consisting of kaolin and sodium silicate, sendust with a phosphorous coating layer, and the addition of silicone resin powder considerably improves the component strength while maintaining a high resistivity and hence lower core losses. The addition of the silicone resin also improves the incremental permeability (compare sample H to samples A and E

Example 2

To illustrate the effect of the silicon resin structure, different silicone resins were tested. A pure methyl silicone resin was compared to phenyl/methyl resins and to pure phenyl resins. Also, the amount of functional groups (hydroxy and ethoxy) were varied, see Table 2. Iron powder coated with a phosphorus layer and an alkali silicate layer containing 1% kaolin and 0.4% sodium silicate was mixed with phosphorus coated sendust (70/30 iron/sendust) and then with 0.4% silicone resin according to Table 2 and 0.5% lubricant mixture of L2 and A-wax; and compacted at 800 MPa and 60 C into rings with an inner diameter of 45 mm, an outer diameter of 55 mm and a height of 5 mm for As can be seen from table 2, it is beneficial to have a pure phenyl silicone resin with a high hydroxyl group contents, as this results in a high incremental permeability and low core losses. By comparing sample G from Table 1 to sample M the effect of warm compaction with the lubricant mixture, L2 and A-wax, is illustrated. The density, permeability, and core loss of the compacted core are all improved.

The invention claimed is:

1. An iron-based powder composition comprising a mixture of:

(a) a first iron-based powder consisting of phosphorous coated atomized iron particles which are further coated by a silicate layer comprising particles of clay;

(b) a second iron-based powder consisting of phosphorous coated iron alloy particles, the iron alloy particles consisting of 7% to 13% by weight silicon, 4% to 7% by weight aluminium, the balance being iron;

(c) a powdered silicone resin in powdered form, and (d) optionally, a lubricant.

2. The iron-based powder composition according to claim 1, wherein the mixture includes the lubricant.

3. The iron based powder composition according to claim 1, wherein the silicone resin contains 50-100% phenyl substituents.

4. The iron based powder composition according to claim 1, wherein the total contents of hydroxy, methoxy and ethoxy functional groups in the silicone resin is above 2 wt %.

5. The iron based powder composition according to claim 1, wherein the melting point of the silicone resin is above 45° C.

6. The iron-based powder composition according to claim 1, wherein the silicate layer further comprises a water soluble alkaline silicate.

7. The iron-based powder composition according to claim 6, wherein the particles of clay comprise one or more phyllosilicates.

8. The iron-based powder composition according to claim 6, wherein the content of alkaline silicate in the silicate layer is between 0.1-0.9% by weight of the composite iron-based powder.

9. The iron based powder composition according to claim 7, wherein the mean particle size of the clay in the silicate layer is below 3.0 μm measured by analytical centrifugal analysis.

10. The iron based powder composition according to claim 7, wherein the content of clay in the silicate layer is between 0.2-5% by weight of the composite iron-based powder.

11. A method for producing a compacted and heat treated component, comprising the steps of:

a) providing a composite iron-based powder composition according to claim 1, b) compacting the composite iron-based powder composition, optionally mixed with a lubricant, in a uniaxial press movement in a die at a compaction pressure between 400 and 1200 MPa, optionally with an elevated temperature of the die, c) ejecting the compacted component from the die, d) heat treating the ejected component in a non-reducing atmosphere at a temperature up to 800° C.

12. A component produced according to the method described in claim 11.

13. The component according to claim 12, said component being an inductor core.

14. An inductor core according to claim 13, having a resistivity, ρ, above 10000 μΩm; an initial relative incremental permeability above 80; and core loss less than 12 W/kg at a frequency of 20 kHz; induction of 0.05 T, wherein the resistivity is measured by a four point measurement, the relative incremental permeability is measured with a hysterisisgraph on rings with an inner diameter of 45 mm, an outer diameter of 55 mm and a height of 5 mm, the rings wired with 100 turn of the primary circuit and 20 turns for the secondary circuit and further wired with a third winding supplying the DC-bias current and wherein the core loss is with a Walker Scientific Inc. AMH-401POD instrument on rings with an inner diameter of 45 mm, an outer diameter of 55 mm and a height of 5 mm, the rings wired with 100 turn of the primary circuit and 30 turns for the secondary circuit.

15. The iron based powder composition according to claim 8, wherein the content of clay in the silicate layer is between 0.2-5% by weight of the composite iron-based powder.

16. An inductor core, having a resistivity, ρ, above 10000 μΩm; an initial relative incremental permeability above 80; and core loss less than 12 W/kg at a frequency of 20 kHz; induction of 0.05 T, wherein the resistivity is measured by a four point measurement, the relative incremental permeability is measured with a hysterisisgraph on rings with an inner diameter of 45 mm, an outer diameter of 55 mm and a height of 5 mm, the rings wired with 100 turn of the primary circuit and 20 turns for the secondary circuit and further wired with a third winding supplying the DC-bias current and wherein the core loss is with a Walker Scientific Inc. AMH-401POD instrument on rings with an inner diameter of 45 mm, an outer diameter of 55 mm and a height of 5 mm, the rings wired with 100 turn of the primary circuit and 30 turns for the secondary circuit, wherein the inductor core is produced by steps comprising:

a) providing a composite iron-based powder composition, b) compacting the composite iron-based powder composition, optionally mixed with a lubricant, in a uniaxial press movement in a die at a compaction pressure between 400 and 1200 MPa, optionally with an elevated temperature of the die, c) ejecting the compacted component from the die, and d) heat treating the ejected component in a non-reducing atmosphere at a temperature up to 800° C., wherein the iron-based powder composition comprises a mixture of:

(a) a first iron-based powder consisting of phosphorous coated atomized iron particles which are further coated by a silicate layer comprising particles of clay;

(b) a second iron-based powder consisting of phosphorous coated iron alloy particles, the iron alloy particles consisting of 7% to 13% by weight silicon, 4% to 7% by weight aluminium, the balance being iron; and (c) a powdered silicone resin in powdered form.

17. The iron-based powder composition according to claim 1, wherein the composition consists of the mixture.

18. The iron based powder composition according to claim 6, wherein the content of clay in the silicate layer is between 0.2-5% by weight of the composite iron-based powder.

19. The iron based powder composition according to claim 1, wherein the silicone resin is 0.3-1.5% by weight of the total mixture.

20. The iron based powder composition according to claim 18, wherein the silicone resin is 0.3-1.5% by weight of the total mixture.

21. The iron-based powder composition according to claim 1, wherein the clay is selected from the group of kaolin, phyllite, and talc.

* * * * *